US006651554B1

(12) United States Patent
Williams

(10) Patent No.: US 6,651,554 B1
(45) Date of Patent: Nov. 25, 2003

(54) PLATEN ASSEMBLY FOR SCREEN PRINTING

(75) Inventor: Bobby J. Williams, Eclectic, AL (US)

(73) Assignee: Russell Corporation, Atlanta, GA (US)

( * ) Notice: Subject to any disclaimer, the term of this patent is extended or adjusted under 35 U.S.C. 154(b) by 0 days.

(21) Appl. No.: 10/150,511

(22) Filed: May 16, 2002

(51) Int. Cl.[7] ..... B41F 15/18
(52) U.S. Cl. ..... 101/126; 101/474
(58) Field of Search ..... 101/114, 115, 101/126, 407.1, 474

(56) References Cited

U.S. PATENT DOCUMENTS 4,846,058 A * 7/1989 Farris ..... 101/123
5,226,362 A * 7/1993 Iaccino et al. ..... 101/129
5,787,805 A * 8/1998 Szyszko et al. ..... 101/123

* cited by examiner

*Primary Examiner*—Andrew H. Hirshfeld
*Assistant Examiner*—Leo Hinze
(74) *Attorney, Agent, or Firm*—Smith, Gambrell & Russell, LLP

(57) ABSTRACT

A bifurcated platen assembly is used to improve screen printing operations by providing parallel spaced apart platens instead of a single platen. The platens occupy the same space as a conventional platen but allows the simultaneous printing on two garment portions or two garments such that alignment problems are eliminated and the operator is able to increase through put production. The platen assembly is movable through a ninety degree arc to facilitate printing on different garments with appropriate screens.

18 Claims, 4 Drawing Sheets

PLATEN ASSEMBLY FOR SCREEN PRINTING

FIELD OF THE INVENTION

The present invention relates to the field of screen printing and more particularly to the field of commercial screen printing wherein multiple prints of the same image are applied to garments such as team or fan wear. More particularly, the present invention relates to an improvement in the screen printing platen assembly used in printing multiple garments with the same image. Specifically, the present invention relates to a platen assembly that allows the press operator to position two garments or garment portions for simultaneous printing on the platen and to orient the platen to print on garment portions in different directions.

BACKGROUND OF THE INVENTION

Printing on T-shirts, jerseys, sweatshirts and other articles of clothing is now common and many manufacturers of garments for the public and for athletic teams routinely use screen printing to place the team logo, name and other specialized indicia on the garment. As trends develop the location and orientation of the image to be printed changes and becomes more challenging. For example, there is now a demand for printing along the legs of sweat pants, down the side strip of shorts, across the yoke of shirts and innumerable other locations and orientations on garments.

Such images are routinely being printed directly onto articles of clothing. In common use in the industry in printing directly onto garments are multi-station, turret type, printing presses. The printing press of this type has a plurality of flat beds or platens spaced along its perimeter. Corresponding to each of these beds may be a series of stations where a part of the indicia is alternately printed and cured. The number of stations employed depends on the number of colors to be printed on the article. In the past, a limitation on the efficiency of the press as a whole has been the ability and speed of the operator in loading a garment on the platen at the initial station and the number of passes through that station or a duplicate station that were required to finish the process.

To print onto the article, it is placed on the platen by the operator with the surface to be printed face up. If the article is a T-shirt, it is slipped over the bed such that the surface to be printed is on the top of the bed. Once printed with the first color, the article must not move or it will be out of registration with the other stations which print the remaining colors. At the initial station of the typical printing press, the article is printed on the flat bed or platen. The bed is typically made of metal such as aluminum or stainless steel. A preformed stencil screen embodying the image to be printed has openings where ink of a particular color is to be deposited onto the article to be printed.

The stencil screen forming the image is placed over the article. Ink of one color conventionally flooded onto the screen. After the ink is flooded onto the screen, the ink is forced through the screen by a squeegee onto the article leaving ink of the desired color where the openings in the screen allowed passage. The squeegee is of any type well-known in the art.

After the excess ink is squeegeed from the screen, the turret type machine is rotated to allow the platen containing the printed clothing to index to the next station where the ink is then dried or cured onto the substrate. Depending on the type of ink used, the ink is either cured on the article by heating it to a critical temperature, or simply by letting it dry if ink containing solvents is used. The platens used in conventional turret machines are sized to fit the body of a shirt such that the printing area is maximized. However, often the image to be printed is not to be placed on the center of the shirt thus the garment must be manipulated by the operator. Likewise, some printing operations are performed on garment portions prior to sewing the garment together, accordingly the operator must often place the individual garment portions in precise alignment on the platen to attempt matching the positions of the images.

SUMMARY OF THE INVENTION

It is the object of the present invention to enable the screen print operator to quickly and accurately position a garment or garment portion on a platen for subsequent screen print operations.

It is another object of the invention to enable the screen print operator to print on multiple garments or portions of garments in a simultaneous operation wherein a plurality of images are formed at once.

It is a still further object of the invention to improve the efficiency of the screen printing process by simplifying the procedures required to print on and form a garment.

These and other objects and features of the invention are accomplished through the use of a bifurcated platen mounted on a base pivotally attached for repositioning in each work station as required. The bifurcated platen has two elongated platen members spaced apart from each other and sized to receive either sleeves of garments or legs of garments. A post depending from each member is connected to a pivotally mounted base member such that both members are translated with the base about a vertical axis. A supplemental platen may be attached to over lie the bifurcated platen for conventional printing.

BRIEF DESCRIPTION OF THE DRAWINGS

Apparatus embodying features of my invention are depicted in the accompanying drawings which form a portion of the this disclosure and wherein.

DESCRIPTION OF A PREFERRED EMBODIMENT

Figure 1:
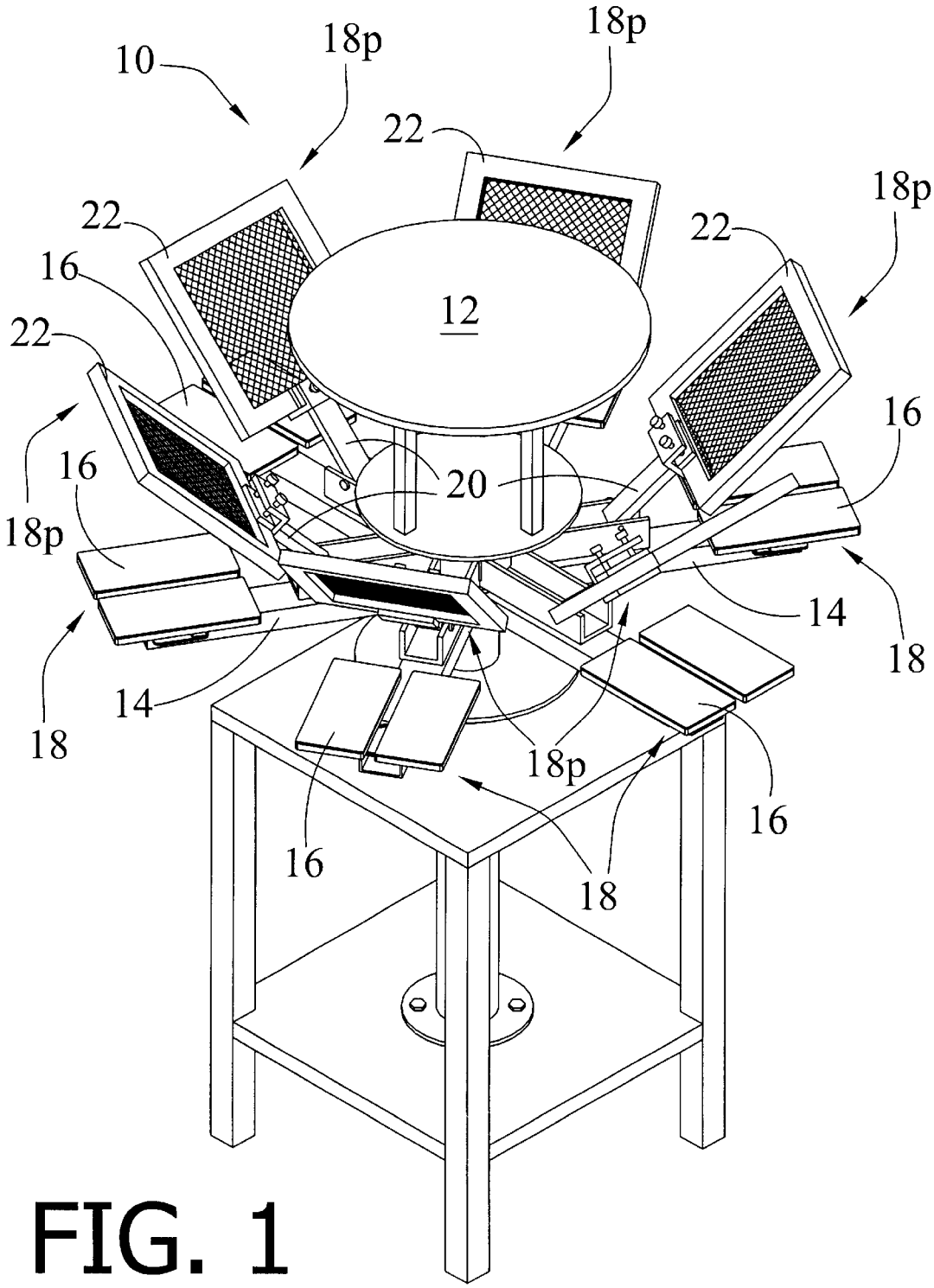
FIG. 1 is a perspective view of platen used with a turret type screen printing machine.

Referring to the drawings for a clearer understanding of the invention, it may be seen in FIG. 1 that the present invention is primarily for use in a turret type screen printing machine 10 wherein a hub 12 has a plurality of arms 14 extending therefrom for supporting a split platen assembly 16 on each arm 14 at a work station 18 including a printing station 18*p*. A movable stencil screen holder 20 is positioned at station 18*p* and allows the operator to bring a stencil screen 22 into registry with the platen assembly 16. The operation of the turret mechanism, the screen holder 20, an associated ink flooding mechanism, and the associated squeegee are all conventional.

Figure 2:
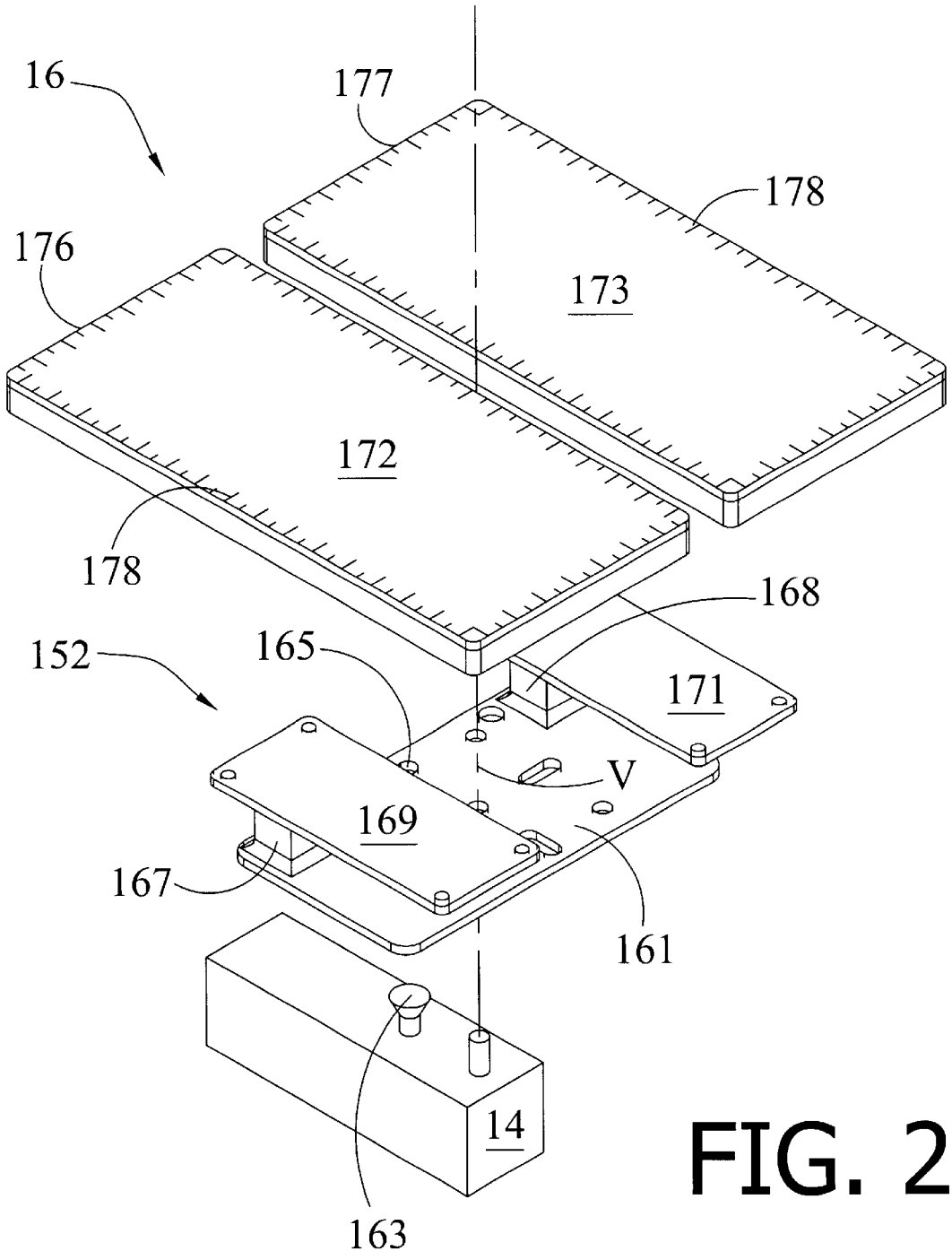
FIG. 2 an exploded perspective view of platen assembly.
Figure 3A:
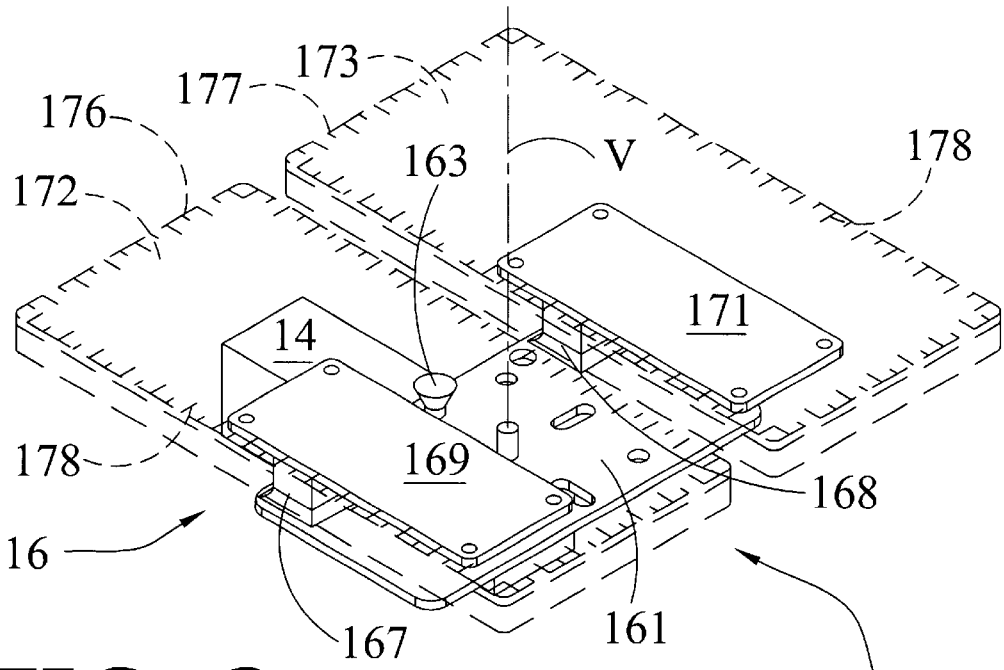
FIG. 3*a* and FIG. 3*b* are perspective view showing the two positions of the platen assembly.
Figure 3B:
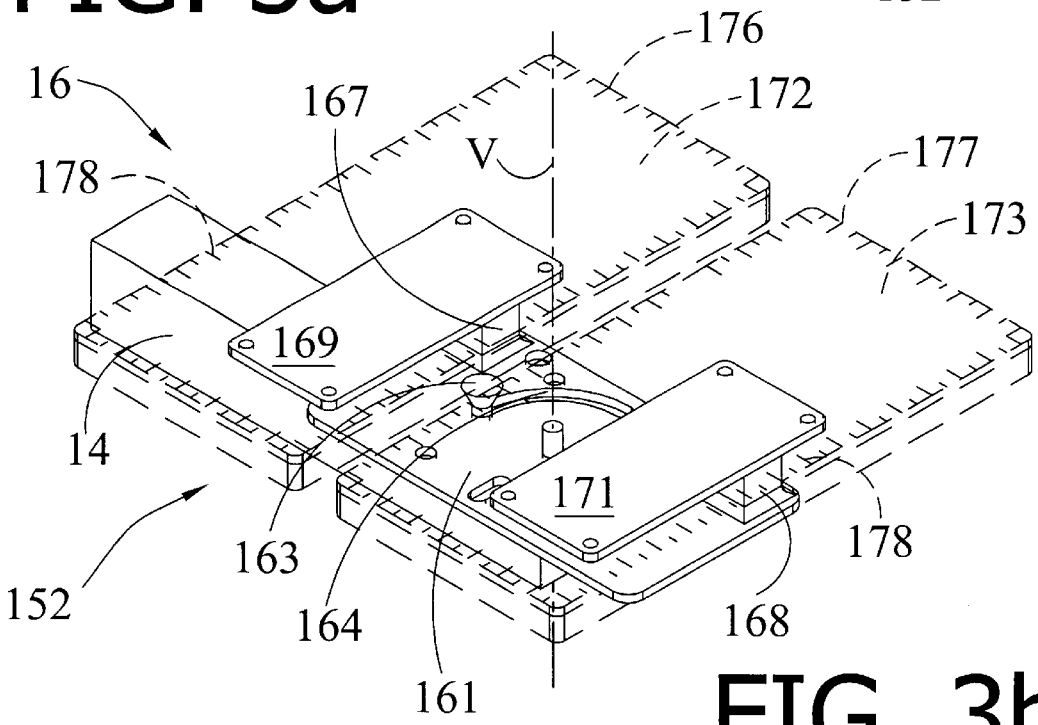

Looking now to FIGS. 2 and 3, platen assembly 16 includes a base 161 mounted to arm 14 and a bracket 152 supported on base 161 for pivotal motion thereon about a vertical axis V extending through arm 14. A guide 163 formed on arm 14 extends upwardly through an arcuate slot 164 formed by bracket 152 subtending a 90 degree arc about vertical axis V. Guide 163 is radially moveable relative to axis V and is locked in a proximal position by an over center linkage beneath arm 14. Slot 164 terminates in detents 165 and 166 which allow guide 163 to positively engage in the detents 165, 166 when locked in its radially inward position. It may be seen that bracket 152 may be moved selectively through the 90 degree arc to either positively locked end position.

Bracket 152 includes a pair of upstanding posts 167 and 168 equally spaced on opposite sides of vertical axis V and terminating in an elongated pair of parallel horizontal supports 169 and 171 which extend perpendicular to arm 14 in one selected position of bracket 152 and parallel to arm 14 in the other selected position of bracket 152. Posts 167 and 168 are affixed to supports 169 and 171 at one end only. Affixed to the top of the supports are platens 172 and 173. Platens 172 and 173 are preferentially made from ¾" plywood with a surface lamination of pressed wood such as sold as Masonite ® and are approximately six to eight inches wide and fourteen to seventeen inches long. The platens 172, 173 are spaced apart by a gap of about one to two inches. Preferentially, the platens 172, 173 are about seven inches wide, sixteen inches long, and spaced apart about one and one half inches. The edges 176 and 177 of the platens 172, 173 are distinct and may be scored with a scale 178 such that garments and garment portions may be perpendicular therewith depending on the position of the platens 172, 173 selected.

In order to achieve the maximum benefit of the split platen assembly 16 the stencil screens are provided with a stencil to overlie each platen 172, 173, therefore, a garment or garment portion loaded on to the parallel platens 172, 173 may have multiple images placed thereon at once. The following examples will illustrate the benefit of the new split platen assembly 16. When printing on sweat pants each leg may be positioned on the platens 172, 173 with the waistband passing over both platens 172, 173 and the crotch material passing between the platens 172, 173, such that images printed on both legs are properly aligned. The sleeves of a jersey may be placed on the platens 172, 173 and aligns such that team logos or stripes on the sleeves are properly aligned. Further a single screen can be used to have the logo properly oriented on the sleeves rather than being reversed on one sleeve. Likewise, garment portions such as the yoke may be printed on both shoulders with the excess material gathered in the gap and again both shoulders may be printed at the same time with complimentary logos or numbers. With the increase in bar printing wherein only a small area of the shirt front is printed on, two shirts can be simultaneously printed by locating them on the two platens 172, 173 with the excess from one shirt falling into the gap.

Many more examples could be recited, however, it should be clear that the use of side by side platens 172, 173 of smaller dimension allows for precise alignment of images on different parts of the garment such as on opposite sleeves, shoulders and legs, thereby significantly increasing the quality control available on the garment produced. Further, the simultaneous printing of these images on the different parts of the garment results in time savings of up to fifty percent, depending on the speed of the operator running the machine. Accordingly, a production worker can produce far more garments per hour using this platen assembly 16 than is possible using a conventional platen, thereby reducing the labor cost for hourly labor and making it possible for piece workers to increase their hourly income.

Figure 4:
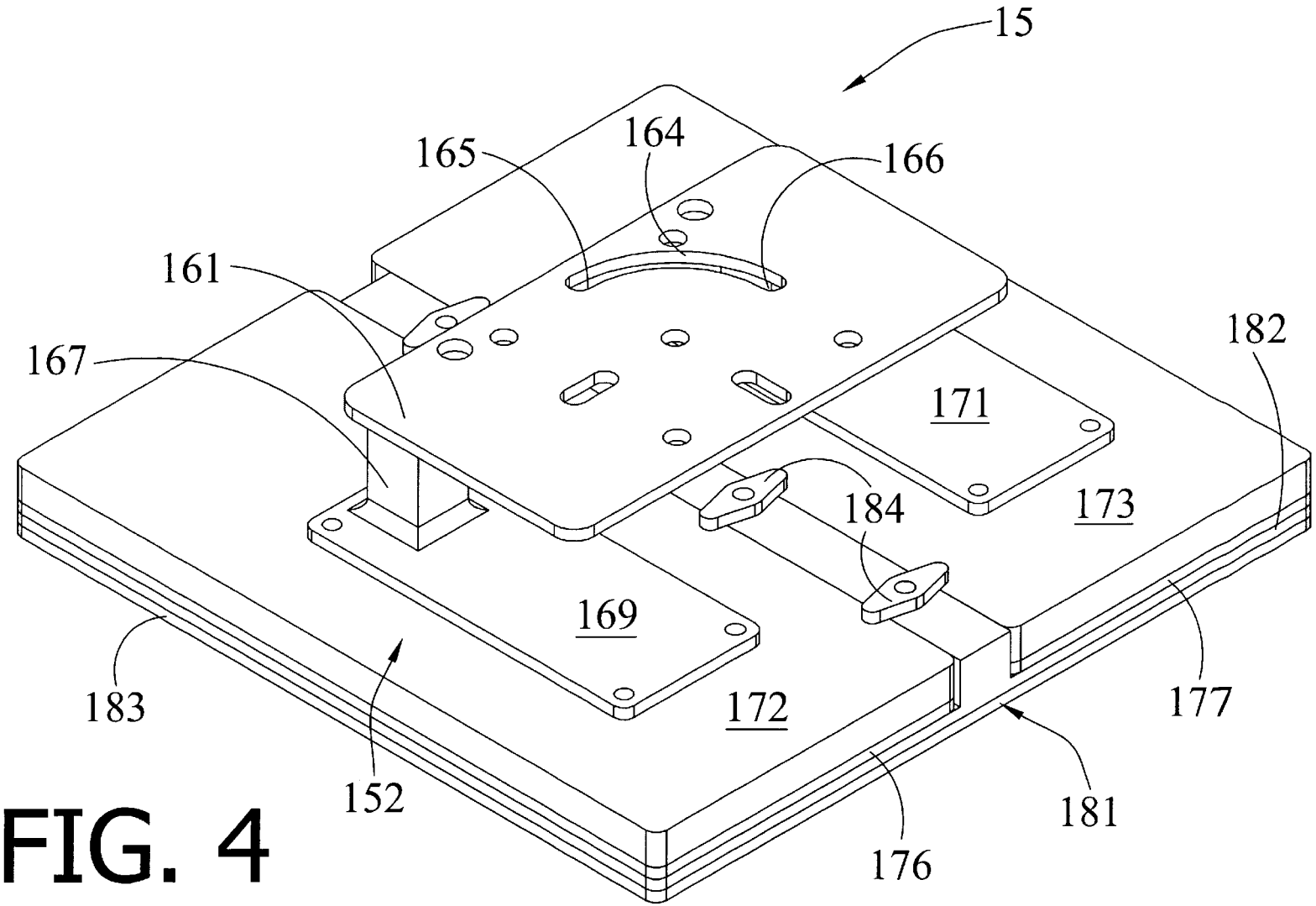
FIG. 4 is an inverted perspective view of the supplemental platen assembly.

Looking now to the illustration in FIG. 4, a supplemental platen 181 may be incorporated into the present invention when it is desirable to have a full size platen. Platen 181 has a metal base backing 182 onto which a pressed wood lamination 183 has been affixed on one side. Opposite the pressed wood lamination 183 backing 182 carries a clamp 184 which fit within the gap between the platens and secures supplemental platen 181 to the bracket assembly 15. Thus a very versatile and efficient platen assembly is provided.

Thus, although there have been described particular embodiments of the present invention of a new and useful IMPROVED PLATEN ASSEMBLY FOR SCREEN PRINTING, it is not intended that such references be construed as limitations upon the scope of this invention except as set forth in the following claims.

What I claim is:

1. In a turret type screen printing press having a plurality of work stations including a printing station through which print media is processed and outwardly extending arms for supporting said print media thereon, means for flooding ink onto a screen at said printing station and means for removing excess ink from the screen at said printing station, the improvement comprising:

a. first and second platen members for holding said print media disposed on the same plane in parallel spaced relation; and b. a unitary support, detachably affixed to one of said outwardly extending arms, including a movable portion thereof rigidly affixed to said first and second platen members and selectively movable between a first position and a second position to selectively position said platen members in said printing station.

2. The improvement as defined in claim 1 wherein said platen members are sized to receive garment portions smaller than the trunk of a garment wearer.

3. The improvement as defined in claim 1 wherein said platen members are spaced apart sufficiently to accommodate excess print media there between.

4. The improvement as defined in claim 1 wherein said media is fabric.

5. The improvement as defined in claim 4 wherein said media is fabric in the form of garment portions.

6. The improvement as defined in claim 4 wherein said media is fabric in the form of garments.

7. The improvement as defined in claim 4 wherein said platen members are sized to hold fabric in the form of complementary garment portions and said screen is configured to concomitantly print complimentary images on said garment portions.

8. The improvement as defined in claim 1 wherein each of said first and second platens have one or more defined edges suitable for alignment of said media therewith.

9. The improvement as defined in claim 8 wherein said platen members are sized to hold print media in the form of complementary garment portions and said screen is configured to concomitantly print complimentary images on said garment portions.

10. The improvement as defined in claim 8 wherein said platen members are sized to hold print media in the form of detached garment portions and said screen is configured to concomitantly print on said garment portions.

11. The improvement as defined in claim 2 wherein said movable portion comprises a base plate pivotally mounted to one of said outwardly extending arms for horizontal rotation about a vertical axis, said base plate extending between said first and second platens, first and second upstanding posts affixed to said base plate on opposite sides of said vertical axis and spaced equidistantly therefrom, platen support plates affixed atop said posts and extending in a plane parallel said base plate and perpendicular said posts with said platens affixed to said platen support plates.

12. The improvement as defined in claim 11 wherein said base plate defines a guide way therein within which a guide affixed to said arm is captured such that pivotal motion of said base plate is limited to a pre-selected angular movement.

13. The improvement as defined in claim 1 further comprising a supplemental platen member comprising a metal substrate and a laminate superimposed thereon having length and width dimensions equivalent to said first and second platens and the space there between, said metal substrate having a depending connector for insertion between said first and second platen to detachably affix said supplemental platen thereto.

14. A platen assembly for use in a screen printing press, wherein the screen press includes a printing station with a movable screen, means for flooding ink onto the screen, means for removing excess ink from the screen, and a support arm for supporting a print media beneath said movable screen, the platen assembly comprising in combination:

a. first and second coplanar platen members for holding said print media; and b. a bracket, detachably affixed to said support arm, including a movable portion affixed to said first and second platen members and selectively movable between a first position and a second position to selectively position said platen members in said printing station, with said platen members remaining in the same plane.

15. The platen assembly as defined in claim 14 wherein said movable portion comprises a base plate pivotally mounted to said support arm for rotation about a central vertical axis, first and second upstanding posts affixed to said base plate on opposite sides of said vertical axis and spaced equidistantly therefrom, elongated platen support plates affixed atop said posts and extending in a plane parallel said base plate and perpendicular said posts with said platens affixed to said platen support plates in spaced apart relation to each other.

16. The platen assembly as defined in claim 15 further comprising a supplemental platen member comprising a metal substrate and a laminate superimposed thereon having length and width dimensions equivalent to said first and second platens and the space there between, said metal substrate having a depending connector for insertion between said first and second platen to detachably affix said supplemental platen thereto.

17. The platen assembly as defined in claim 15 wherein said platen members are sized to hold print media in the form of garment portions and said screen is configured to concomitantly print on said garment portions.

18. The platen assembly as defined in claim 17 wherein said platen members are sized to receive garment portions smaller than the trunk of a garment wearer.

* * * * *